US007698777B2

(12) United States Patent
Fujiwara et al.

(10) Patent No.: US 7,698,777 B2
(45) Date of Patent: Apr. 20, 2010

(54) VACUUM CLEANER

(75) Inventors: Tosiaki Fujiwara, Shiga (JP); Hiroshi Nakao, Shiga (JP); Masaki Takahashi, Shiga (JP); Nobuhiro Hayasi, Shiga (JP)

(73) Assignee: Panasonic Corporation, Osaka (JP)

( * ) Notice: Subject to any disclaimer, the term of this patent is extended or adjusted under 35 U.S.C. 154(b) by 900 days.

(21) Appl. No.: 11/362,780

(22) Filed: Feb. 28, 2006

(65) Prior Publication Data

US 2007/0136980 A1 Jun. 21, 2007

(30) Foreign Application Priority Data

Dec. 16, 2005 (JP) ..... 2005-363008

(51) Int. Cl.
*A47L 5/00* (2006.01)

(52) U.S. Cl. ..... 15/339; 15/319

(58) Field of Classification Search ..... 15/319, 15/339

See application file for complete search history.

(56) References Cited

U.S. PATENT DOCUMENTS 5,276,939 A * 1/1994 Uenishi ..... 15/319
5,881,430 A * 3/1999 Driessen et al. ..... 15/319
6,457,205 B1 * 10/2002 Conrad ..... 15/319

FOREIGN PATENT DOCUMENTS

JP 05-023273 A 2/1993
JP 11-221180 8/1999
JP P2005-278687 A 10/2005

* cited by examiner

*Primary Examiner*—Joseph J Hail, III
*Assistant Examiner*—Shantese McDonald
(74) *Attorney, Agent, or Firm*—Bacon & Thomas, PLLC

(57) ABSTRACT

A vacuum cleaner includes an electric blower, an electric blower controller for controlling the electric blower, an electric blower current detector for detecting at least a current flowing in the electric blower, and a dust chamber provided at an upstream of the electric blower, for collecting dust particles sucked by the electric blower. A predetermined level of a current is made to flow in the electric blower regardless of a dust particle amount in the dust chamber. Preferably, the vacuum cleaner further includes voltage detector for detecting a voltage of a power supply applied to the vacuum cleaner. More preferably, the vacuum cleaner further includes a frequency detector for detecting a frequency of a power supply applied to the vacuum cleaner.

17 Claims, 7 Drawing Sheets

VACUUM CLEANER

FIELD OF THE INVENTION

The present invention relates to a vacuum cleaner; and, more particularly, to a vacuum cleaner in which an electric current flowing therein can be controlled.

BACKGROUND OF THE INVENTION

Recently, there have been developed vacuum cleaners in which electric powers provided to electric blowers therein can be controlled by detecting negative pressures inside the vacuum cleaners in order to improve suction forces. Further, in some vacuum cleaners, power consumptions are controlled to be reduced when suction flow rates are higher than a specific level while amounts of collected dust are low (see, for example, Japanese Patent No. 3326126).

FIG. 7 shows a graph representing an electric power and a current as a function of a suction flow rate in accordance with the power control method disclosed in Japanese Patent No. 3326126. As shown therein, the electric power represented as an effective power is reduced where the suction flow rate gets high. However, in this region, a total current is not reduced, because a reactive power is high and thus a power factor is low. This is not a favorable situation for a power company supplying the electric power. Further, in some cases, it may be needed to examine whether a current rating of the power supply system has to be reset, and thus, a reexamination of an upper limit of a current level of a current breaker in a distributor box provided for each household, a replacement of the current breaker, or an electrical service work may be required.

For example, in the United States, a maximum current of household electric appliances is set to be 12 A by the regulation. Conventionally, for a vacuum cleaner including an electric blower but not including an electric motor, a rated current of the electric blower is set to be 12 A. Further, for a vacuum cleaner including an electric blower and an electric motor attached thereto, a rated current of the electric blower and that of the electric motor are set to be 10 A and 2 A, respectively. Thus, vacuum cleaners set rated current loads within the maximum current limit.

Further, among such vacuum cleaners including an electric blower and an electric motor attached thereto, there is developed a vacuum cleaner capable of controlling the number of rotation of the electric motor for, e.g., driving a rotational brush in a nozzle used for the vacuum cleaner, in addition to a function of adjusting a suction force by controlling the electric power of the electric blower.

SUMMARY OF THE INVENTION

It is, therefore, an object of the present invention to provide a vacuum cleaner capable of suppressing a load current to be equal to or lower than a predetermined level while maintaining a high suction force regardless of an amount of collected dust, and further, eliminating the necessity for the user or the power company to examine whether a current rating for the power distribution system has to be reset.

In accordance with one aspect of the present invention, there is provided a vacuum cleaner including: an electric blower; an electric blower controller for controlling the electric blower; an electric blower current detector for detecting at least a current flowing in the electric blower; and a dust chamber provided at an upstream of the electric blower, for collecting dust particles sucked by the electric blower, wherein a predetermined level of a current is made to flow in the electric blower regardless of a dust particle amount in the dust chamber. With this configuration, by setting the predetermined level of the current to be, for example, slightly lower than a current level for operating a current breaker, the current breaker is not operated during a cleaning operation. Therefore, it is not necessary to examine whether a current rating of the power supply system has to be reset, and a high suction force can be maintained regardless of a dust particle amount in a dust chamber.

In accordance with another aspect of the present invention, there is provided a vacuum cleaner including: a vacuum cleaner comprising: an electric blower; an electric blower controller for controlling the electric blower; an electric motor for driving a rotational brush for brushing dust particles to be removed from a surface to be cleaned; an electric motor controller for controlling the number of rotation of the electric motor; a current detector for detecting at least a total current equal to a sum of a current flowing in the electric motor and a current flowing in the electric blower; and a dust chamber provided at an upstream of the electric blower, for collecting dust particles sucked by the electric blower, wherein the total current is controlled to be maintained at a predetermined level regardless of a condition of the surface to be cleaned and a dust particle amount in the dust chamber. With this configuration, by setting the predetermined level of the current to be, for example, slightly lower than a current level for operating a current breaker, the current breaker is not operated during a cleaning operation. Therefore, it is not necessary to examine whether a current rating of the power supply system has to be reset, and a high suction force as well as a high brushing force can be maintained regardless of a dust particle amount in a dust chamber.

Preferably, the vacuum cleaner further includes an electric power setting unit for setting an electric power of the electric blower, wherein the total current is controlled to be maintained at a predetermined level by increasing the number of rotation of the electric motor if the electric power set by the electric power setting unit is not a maximum power, regardless of the electric power set by the electric power setting unit, a condition of the surface to be cleaned and the dust particle amount in the dust chamber. In this configuration, when the suction flow rate is set to be intermediate or low to reduce the suction force, the current flowing in the electric blower is increased by as much as the decrement in the current due to the reduction of the suction force, and thus the number of rotation of the electric blower is increased, so that the brushing force is increased to maintain a high cleaning efficiency of the vacuum cleaner.

Preferably, the vacuum cleaner further includes a rotation number setting unit for setting the number of rotation of the electric motor, wherein, if the number of rotation set by the rotation number setting unit is not a maximum number of rotation, the total current is controlled to be kept a predetermined level by increasing the electric power of the electric blower, regardless of the number of rotation set by the rotation number setting unit, a condition of the surface to be cleaned and the dust particle amount in the dust chamber. In this configuration, when the the number of the electric blower is lowered by the rotation number setting unit to reduce the suction force, the current flowing in the electric blower is increased by as much as the decrement in the current flowing in the electric motor. Thus, the electric power provided to the electric blower is increased to the suction force is increased, thereby ensuring a high cleaning efficiency of the vacuum cleaner.

Preferably, the current detector includes an electric blower current detector for detecting a current flowing in the electric blower and an electric motor current detector for detecting a current flowing in the electric motor. With this configuration, a high cleaning efficiency of the vacuum cleaner can be ensured.

Preferably, the vacuum cleaner further includes a voltage detector for detecting a voltage of a power supply applied to the vacuum cleaner, wherein a predetermined level of a current is made to flow in the vacuum cleaner regardless of a change in the voltage of the power supply. In this configuration, even when the voltage of the power supply is varying, the total current can be maintained within the predetermined level of the current for a user's convenience.

Preferably, the vacuum cleaner further includes a frequency detector for detecting a frequency of a power supply applied to the vacuum cleaner, wherein a predetermined level of a current is made to flow in the vacuum cleaner regardless of a change in the frequency of the power supply. In this configuration, even when the frequency of the power supply is varying, the total current can be maintained within the predetermined level of the current for a user's convenience.

Preferably, the electric blower current detector includes a variable factor detector for detecting variable factors other than the current flowing in the electric blower, wherein the current flowing in the electric blower is indirectly estimated based on the variable factors detected by the variable factor detector. In this configuration, by estimating the current flowing in the electric blower based on a detection result of a pressure sensor for detecting an amount or a state of the collected dust in the dust chamber, a unit for detecting the current flowing in the electric blower can be omitted to reduce the manufacturing cost.

Preferably, the vacuum cleaner further includes a cleaning mode detector for detecting whether the vacuum cleaner is in a floor cleaning mode or a non-floor cleaning mode, wherein, in case of the non-floor cleaning mode, an operation of a rotational brush or an electric motor is stopped, and then, the current of the electric blower is increased by as much as a decrement in the current caused by stopping the rotational brush or the electric motor. With this configuration, a high suction force can be maintained.

Preferably, the vacuum cleaner further includes a time counter for detecting a duration of the non-floor cleaning mode of the vacuum cleaner, wherein, if the non-floor cleaning mode is shorter than or equal to a predetermined time period, the current of the electric blower is not increased. In this configuration, even when a temporary non-floor cleaning mode is maintained for a short period of time or an output signal of the cleaning mode detector is unstable, the current flowing in the electric blower is not increased. Therefore, a cleaning operation can be performed in a stable state without an abrupt change in the current.

Preferably, the predetermined level of the total current flowing in the vacuum cleaner is set to be an upper limit set by the regulation or a constant level smaller than the upper limit. With this configuration, the vacuum cleaner can be stably used without reexamining the power distribution system for providing the electric power to the vacuum cleaner.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENT

Preferred embodiments of the present invention will be described in detail with reference to the accompanying drawings. However, the present invention should not be construed to be limited thereto.

First Embodiment

Figure 1:
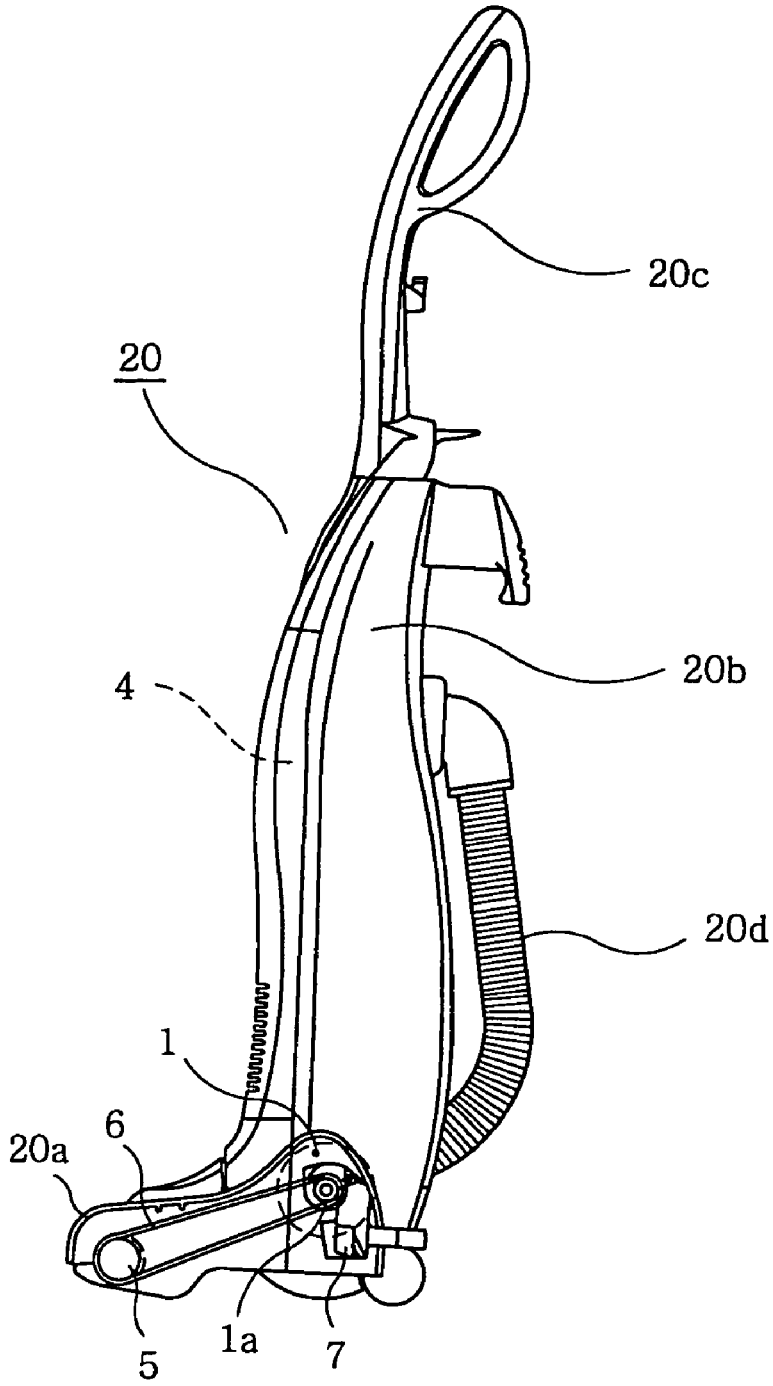
FIG. 1 shows an exterior view of a vacuum cleaner in accordance with a first preferred embodiment of the present invention.

A vacuum cleaner in accordance with a first preferred embodiment of the present invention will be described with reference to FIGS. 1 to 4. FIG. 1 shows an exterior view of a vacuum cleaner in accordance with a first preferred embodiment of the present invention; and FIG. 2 describes a circuit block diagram of the vacuum cleaner in accordance with the first preferred embodiment of the present invention.

Figure 2:
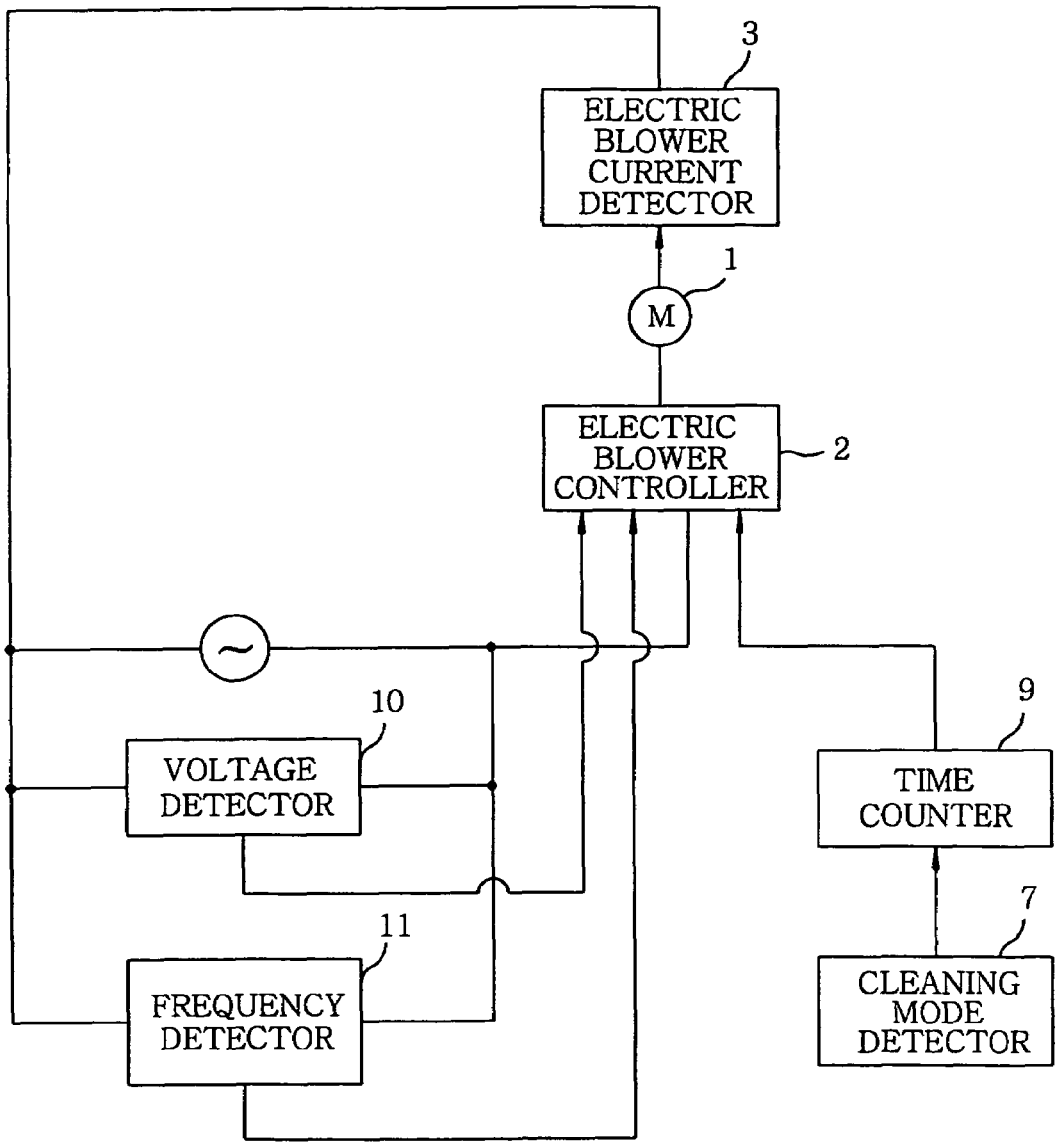
FIG. 2 describes a circuit block diagram of the vacuum cleaner in accordance with the first preferred embodiment of the present invention.

Referring to FIGS. 1 and 2, there is illustrated vacuum cleaner main body 20 including bottom nozzle 20*a* accommodating therein rotational brush 5 for brushing up dust particles; main body 20*b*, tiltably connected to bottom nozzle 20*a*, for accommodating therein electric blower 1 for sucking dust particles in and having dust chamber 4 for collecting the dust particles sucked in; manipulating handle 20*c* fixed to an upper end of main body 20*b*; and hose 20*d* for connecting dust chamber 4 with bottom nozzle 20*a* for communicating therewith.

Electric blower controller 2 controls electric blower 1, and electric blower current detector 3 detects a current flowing in electric blower 1. Rotational brush 5 is connected to output shaft 1*a* of electric blower 1 via belt 6. Provided between output shaft 1*a* and rotational brush 5 is a rotational brush switching mechanism for controlling to make belt 6 be mechanically engaged with or disengaged from rotational brush 5. Rotational brush 5 is driven to be rotated or stopped by means of the rotational brush switching mechanism.

Floor cleaning mode detection unit 7 detects whether the vacuum cleaner is in a floor cleaning mode or a non-floor cleaning mode based on a state of the rotational brush switching mechanism. In case of the non-floor cleaning mode, the rotation of rotational brush 5 is stopped and, then, a current of electric blower 1 is increased by as much as a reduced current of rotational brush 5.

Figure 3A:
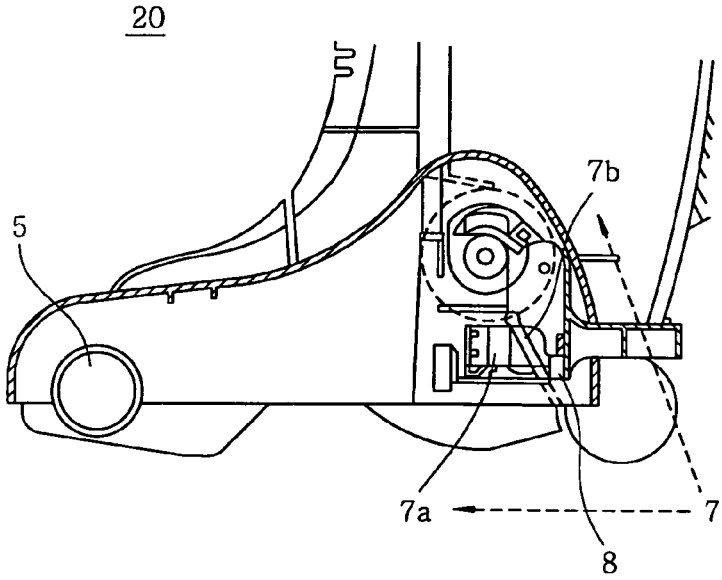
FIGS. 3A and 3B provide exterior views showing main parts of the vacuum cleaner in a non-floor cleaning mode and in a floor cleaning mode, respectively.
Figure 3B:
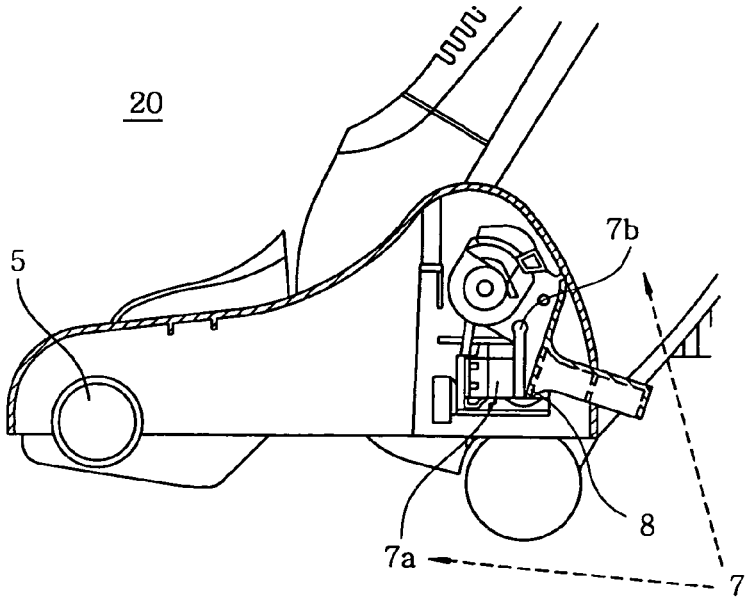

FIG. 3 shows the non-floor cleaning mode and the floor cleaning mode of the vacuum cleaner. The non-floor cleaning mode is defined as a state where main body 20*b* is kept standing up as illustrated in FIG. 1, and one end portion of hose 20*d* which is nearer to bottom nozzle 20*a* is pulled out to be attached to a cleaning attachment (not shown), so that furniture or the like can be cleaned with the cleaning attachment. In this state, electric blower 1 is in operation, whereas rotational brush 5 is kept stalled by the rotational brush switching mechanism. On the other hand, the floor cleaning mode is defined as a state where main body 20 is inclined backwardly and being moved around a surface to be cleaned by using handle 20*c* to clean the surface to be cleaned. At this time, not only electric blower 1 is in operation, but also rotational brush 5 is being rotated.

In accordance with the present invention, as shown in FIG. 3, micro switch 7*a* is used as floor cleaning mode detection unit 7. Lever 7*b* of micro switch 7*a* is configured to be manipulated by protrusion 8 formed as a single body with vacuum cleaner main body 20.

In the non-floor cleaning mode, since protrusion 8 does not manipulate lever 7*b*, micro switch 7*a* is off. On the other hand, in the floor cleaning mode, since protrusion 8 manipulates lever 7*b*, micro switch 7*a* is on.

Time counter 9 measures a duration of the non-floor cleaning mode of the vacuum cleaner. If the non-floor cleaning mode is shorter than or equal to a predetermined time period, e.g., one second as set in the present embodiment, an operation for increasing the current of electric blower 1 by as much as a current flowing in the load of rotational brush 5 is not performed. Voltage detector 10 detects a voltage of a power supply of a power supply applied to the vacuum cleaner, and frequency detector 11 detects a frequency of the power supply of the vacuum cleaner. Those two detectors detect a variation in the voltage of the power supply or the frequency of the power supply, so that a predetermined level of total current flows in electric blower 1 regardless of the variation in the voltage of the power supply or the frequency of the power supply.

Further, in accordance with the present embodiment, the predetermined level of the total current flowing in the vacuum cleaner, i.e., the current mainly flowing in electric blower 1, is set to be a regular level (11.5 A) that is smaller than a maximum level (12 A) pursuant to the regulation of the United States.

The following is an explanation of an operation of the vacuum cleaner configured as described above.

Figure 4A:
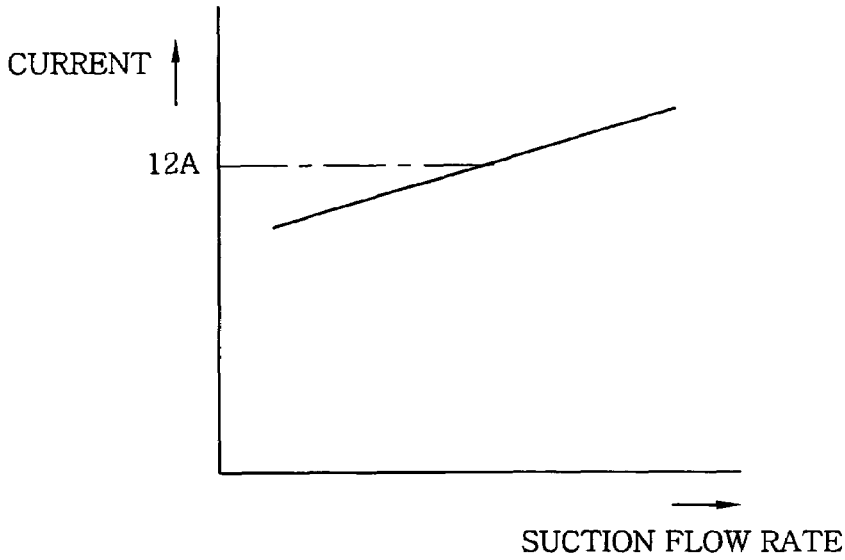
FIGS. 4A and 4B illustrate graphs of a current as a function of a suction flow rate (a dust particle amount) in cases of not controlling the current and controlling the current, respectively.
Figure 4B:
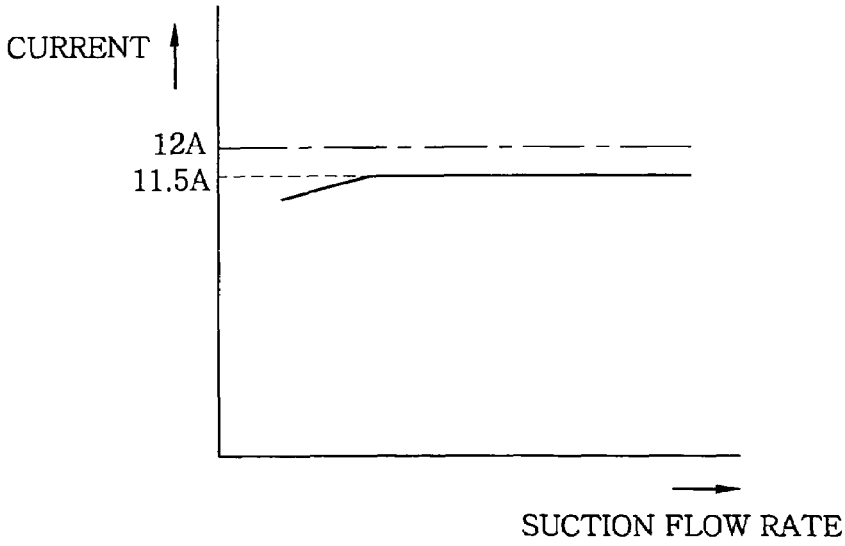

FIGS. 4A and 4B illustrate graphs of a current as a function of a suction flow rate in cases of not controlling the current and controlling the current, respectively. A suction flow rate can be detected by electric blower current detector 3 for detecting the current in electric blower 1 in case of not controlling the current, and, based thereon, the current is controlled to be kept at a predetermined level (11.5 A) when the suction flow rate is higher than a specific level, as shown in FIG. 4B.

Hereinafter, such operation will be described with reference to FIG. 2.

Firstly, in case the power supply is rated at 120 V and 60 Hz, a 120 V signal and a 60 Hz signal are outputted from voltage detector 10 and frequency detector 11, respectively.

(a) Non-floor Cleaning Mode

Since rotational brush 5 is stopped, there is no frictional resistance on a surface to be cleaned, and thus electric blower 1 is driven under a condition where a load of rotational brush 5 is not imposed. Accordingly, based on the characteristics shown in FIG. 4, the current of electric blower 1 is controlled to be constant (11.5 A) by electric blower controller 3.

(b) Floor Cleaning Mode

Since rotational brush 5 is being rotated, the frictional resistance on the surface to be cleaned is being applied to electric blower 1 via belt 6 and, thus, electric blower 1 is driven under a slightly loaded condition. However, a frictional force on the surface to be cleaned varies as the vacuum cleaner is moved around. Therefore, although the current of electric blower 1 slightly increases compared to that in the non-floor cleaning mode, its level (load current of the rotational brush) is not constant.

In this manner, the current of electric blower 1 is controlled to be constant (11.5 A) by electric blower controller 2 so that a change in the current is suppressed.

In a case where the non-floor cleaning mode and the floor cleaning mode are frequently alternated, or in a case where, during the floor cleaning mode, the vacuum cleaner is inclined to a degree between that of the floor cleaning mode and that of the non-floor cleaning mode, and an output of cleaning mode detector 7 is unstable for about one second, time counter 9 determines that the non-floor cleaning mode is being continued and, thus, the load current of rotational brush 5 is not increased.

Further, in case the power supply is rated at certain levels other than 120 V and 60 Hz, a voltage signal based on a voltage of the power supply is outputted from voltage detector 10, and a frequency signal based on a frequency of the power supply is outputted from frequency detector 11. Thereafter, electric blower controller 2 controls a load current of electric blower 1 to be constant (11.5 A) in response to the voltage signal and the frequency signal.

In other words, in accordance with the present embodiment, the surface to be cleaned can be cleaned while keeping the current to be constant (11.5 A) and thus maintaining a maximum suction force, regardless of an amount of collected dust, a condition of the surface to be cleaned, a cleaning state, the voltage of the power supply, the frequency of the power supply, and the like.

Second Embodiment

Figure 5:
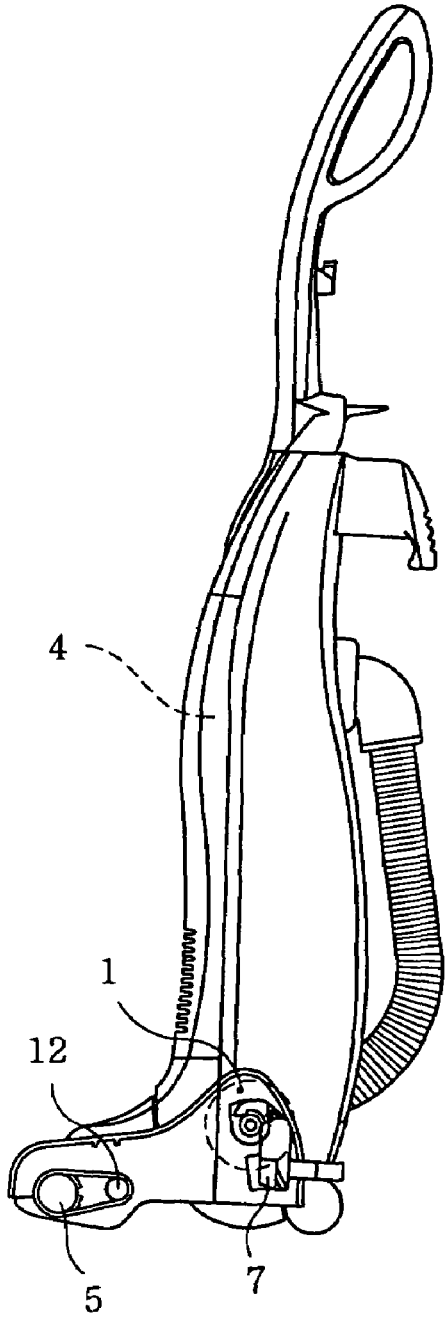
FIG. 5 offers an exterior view of a vacuum cleaner in accordance with a second preferred embodiment of the present invention.
Figure 6:
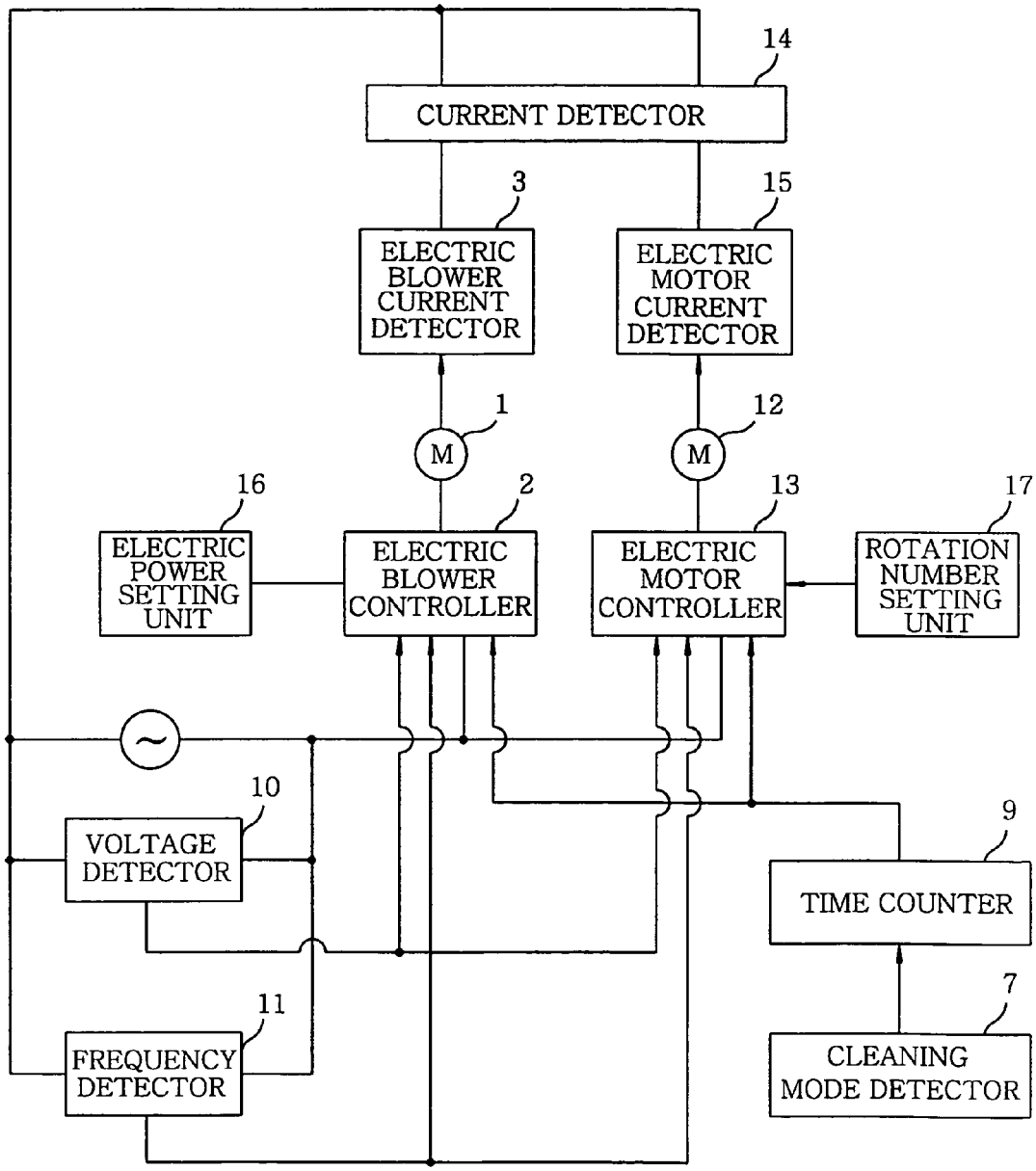
FIG. 6 depicts a circuit block diagram of the vacuum cleaner in accordance with the second preferred embodiment of the present invention.
Figure 7:
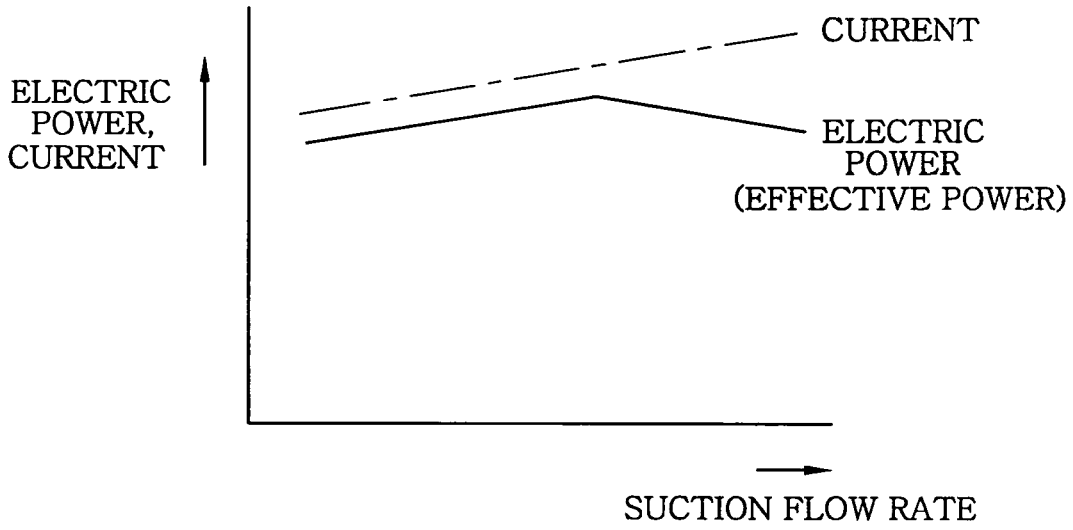
FIG. 7 illustrates a graph of a current and an electric power as a function of a suction flow rate in accordance with a prior art.

FIG. 5 offers an exterior view of a vacuum cleaner in accordance with a second preferred embodiment of the present invention; and FIG. 6 depicts a circuit block diagram of the vacuum cleaner in accordance with the second preferred embodiment of the present invention. Detailed explanations of parts identical or similar to those described in the first preferred embodiment will be omitted, and like reference numerals will be used therefor.

In the first preferred embodiment, rotational brush 5 is driven to be rotated by electric blower 1. However, in the present embodiment, electric motor 12 for rotating rotational brush 5 is provided and driven independently from electric blower 1.

Referring to FIGS. 5 and 6, there are illustrated electric motor controller 13 for controlling the number of rotation of electric motor 12; electric motor current detector 15 for detecting a current flowing in electric motor 12; electric blower current detector 3 for detecting a current flowing in electric blower 1; and current detector 14 for detecting a total current of the current detected by electric motor current detector 15 and the current detected by electric blower current detector 3.

Electric power setting unit 16 sets an electric power of electric blower 1. If the electric power set by electric power setting unit 16 is not a maximum power, a predetermined level of a total current is made to flow by increasing the number of rotation of electric motor 12 regardless of the electric power set by electric power setting unit 16. On the other hand, rotation number setting unit 17 sets the number of rotation of electric motor 12. If the number of rotation set by rotation number setting unit 17 is not a maximum number of rotation, the predetermined level of the total current is made to flow by increasing the electric power of electric blower 1 regardless of the number of rotation set by rotation number setting unit 17.

That is, in accordance with the present embodiment, the predetermined level of the total current flowing in the entire vacuum cleaner is set to be a constant level, 11.5 A, which is smaller than an upper limit set by the regulation, wherein the predetermined level of the total current is, in the non-floor cleaning mode, approximately the current flowing in electric blower 1, and in the floor cleaning mode, approximately a sum of the currents flowing in electric blower 1 and electric motor 12, respectively.

Hereinafter, an operation of the vacuum cleaner configured as described above will be explained with reference to FIG. 6.

(a) Non-floor Cleaning Mode

In the non-floor cleaning mode, electric motor 12 is not in operation, so that rotational brush 5 remains stationary, and operations same as those in the non-floor cleaning mode in accordance with the first embodiment are performed.

(b) Floor Cleaning Mode

In the floor cleaning mode, electric motor 12 is in operation, so that rotational brush 5 is also driven to be rotated and operations same as those in the floor cleaning mode in accordance with the first embodiment are performed. However, the current of electric blower 1 in the present embodiment is lower than that in the first embodiment by as much as the current of the electric motor 12, because electric motor 12 is additionally installed in the present embodiment.

In this manner, similarly to the first embodiment, the surface to be cleaned can be cleaned while keeping the current to be maintained at a constant level (11.5 A) and thus maintaining a maximum suction force, regardless of an amount of collected dust, a condition of the surface to be cleaned, a cleaning state, the voltage of the power supply, the frequency of the power supply, and the like.

In case the electric power set by electric power setting unit 16 is lower than the maximum power, the current of electric blower 1 is lower than a maximum level. However, since electric motor controller 13 increases the number of rotation of electric motor 12 to correspond to a decrement in the current of electric blower 1, a cleaning efficiency of a specific level can be ensured by increasing a brushing force of rotational brush 5, even if a suction force is set to be low.

On the other hand, in case the number of rotation set by rotation number setting unit 17 is lower than a maximum number of rotation, the current of electric motor 12 and thus the load current of rotational brush 5 for cleaning the surface to be cleaned are reduced. However, since electric blower controller 2 increases the electric power of electric blower 1 to correspond to the decrement of the current, a cleaning efficiency of a specific level can be ensured by increasing the suction force even if the number of rotation is set to be small.

Although a predetermined level of a current is set to be 11.5 A in the embodiment described above, it can be set smaller if the electric power or the number of rotation thereof is not set to be maximum, depending on a performance of electric blower 1 or electric motor 12.

Further, in the embodiments described above, the current flowing in electric blower 1 is directly detected by electric blower current detector 3. However, if the current flowing in electric blower 1 is indirectly estimated and controlled based on a detection result of a detector for detecting variable factors other than the current flowing in the electric blower, such as a pressure sensor for detecting an amount of collected dust or a state of dust accumulation in the dust chamber, the electric blower current detector becomes unnecessary. As a result, the vacuum cleaner can be designed at a low cost.

As described above, in the vacuum cleaner in accordance with the present invention, the current of the vacuum cleaner can be controlled to be a specific level, e.g., 11.5 A, which is slightly smaller than an upper limit set by the regulation regardless of an amount of collected dust, a preset electric power of an electric blower, a preset number of rotation of an electric motor, a voltage of the power supply, a frequency of the power supply, an operation mode (floor cleaning mode or non-floor cleaning mode), or the like. Thus, a user can secure a high cleaning efficiency (e.g., suction force, and a dust-brushing force) without reexamining a power distribution system thereof. As a result, the vacuum cleaner of the present invention can be applied to various household or commercial environments.

As descried above, in the vacuum cleaner of the present invention, a current breaker is not operated during a cleaning operation if a predetermined level of a current, which is set to be slightly smaller than a level for the current breaker to be operated, is made to flow in the electric blower. Thus, there is no necessity to examine whether a current rating of the power distribution system has to be reset, or whether an electric service work has to be performed. Further, a high suction force can be maintained regardless of a dust particle amount in a dust chamber.

While the invention has been shown and described with respect to the preferred embodiments, it will be understood by those skilled in the art that various changes and modification may be made without departing from the scope of the invention as defined in the following claims.

What is claimed is:

1. A vacuum cleaner comprising:

an electric blower;

an electric blower controller for controlling the electric blower;

an electric blower current detector for detecting at least a current flowing in the electric blower;

a dust chamber provided upstream of the electric blower for collecting dust particles sucked by the electric blower, a cleaning mode detector for detecting whether the vacuum cleaner is in a flooring cleaning mode or a non-floor cleaning mode, wherein a predetermined level of a current is made to flow in the electric blower regardless of a dust particle amount in the dust chamber, and when the vacuum cleaner is in the non-floor cleaning mode, an operation of an electric motor is stopped and then the current of the electric blower is increased by as much as a decrement in a current of the rotational brush or the electric motor caused by stopping the rotational brush or the electric motor, and a time counter for detecting a duration of the non-floor cleaning mode of the vacuum cleaner, wherein, if the non-floor cleaning mode is shorter than or equal to a predetermined time period, the current of the electric blower is not increased.

2. The vacuum cleaner of claim 1, further comprising a voltage detector for detecting a voltage of a power supply applied to the vacuum cleaner, wherein a predetermined level of a current is made to flow in the vacuum cleaner regardless of a change in the voltage of the power supply.

3. The vacuum cleaner of claim 1, wherein the electric blower current detector includes a variable factor detector for detecting variable factors other than the current flowing in the electric blower, wherein the current flowing in the electric blower is indirectly estimated based on the variable factors detected by the variable factor detector.

4. The vacuum cleaner of claim 1, wherein the predetermined level of the total current flowing in the vacuum cleaner is set to be an upper limit set by the regulation or a constant level smaller than the upper limit.

5. A vacuum cleaner comprising:

an electric blower;

an electric blower controller for controlling the electric blower;

an electric motor for driving a rotational brush for brushing dust particles to be removed from a surface to be cleaned;

an electric motor controller for controlling the number of rotation of the electric motor;

a current detector for detecting at least a total current equal to a sum of a current flowing in the electric motor and a current flowing in the electric blower;

a dust chamber provided upstream of the electric blower for collecting dust particles sucked by the electric blower, a cleaning mode detector for detecting whether the vacuum cleaner is in a flooring cleaning mode or a non-floor cleaning mode, wherein the total current is controlled to be maintained at a predetermined level regardless of a condition of the surface to be cleaned and a dust particle amount in the dust chamber, and when the vacuum cleaner is in the non-floor cleaning mode, an operation of a rotational brush or the electric motor is stopped and then the current of the electric blower is increased by as much as a decrement in a current of the rotational brush or the electric motor caused by stopping the rotational brush or the electric motor, and a time counter for detecting a duration of the non-floor cleaning mode of the vacuum cleaner, wherein, if the non-floor cleaning mode is shorter than or equal to a predetermined time period, the current of the electric blower is not increased.

6. The vacuum chamber of claim 5, wherein the current detector includes an electric blower current detector for detecting a current flowing in the electric blower and an electric motor current detector for detecting a current flowing in the electric motor.

7. The vacuum cleaner of claim 5, further comprising a voltage detector for detecting a voltage of a power supply applied to the vacuum cleaner, wherein a predetermined level of a current is made to flow in the vacuum cleaner regardless of a change in the voltage of the power supply.

8. The vacuum cleaner of claim 5, further comprising a frequency detector for detecting a frequency of a power supply applied to the vacuum cleaner, wherein a predetermined level of a current is made to flow in the vacuum cleaner regardless of a change in the frequency of the power supply.

9. The vacuum cleaner of claim 5, wherein the electric blower current detector includes a variable factor detector for detecting variable factors other than the current flowing in the electric blower, wherein the current flowing in the electric blower is indirectly estimated based on the variable factors detected by the variable factor detector.

10. The vacuum cleaner of claim 5, wherein the predetermined level of the total current flowing in the vacuum cleaner is set to be an upper limit set by the regulation or a constant level smaller than the upper limit.

11. A vacuum cleaner comprising:

an electric blower;

an electric blower controller for controlling the electric blower;

an electric motor for driving a rotational brush for brushing dust particles to be removed from a surface to be cleaned;

an electric motor controller for controlling the number of rotation of the electric motor;

a current detector for detecting at least a total current equal to a sum of a current flowing in the electric motor and a current flowing in the electric blower;

a dust chamber provided upstream of the electric blower for collecting dust particles sucked by the electric blower, an electric power setting unit for setting an electric power of the electric blower, wherein the total current is controlled to be maintained at a predetermined level by increasing the number of rotation of the electric motor if the electric power set by the electric power setting unit is not a maximum power, regardless of the electric power set by the electric power setting unit, a condition of the surface to be cleaned and the dust particle amount in the dust chamber, and a frequency detector for detecting a frequency of a power supply applied to the vacuum cleaner, wherein a predetermined level of a current is made to flow in the vacuum cleaner regardless of a change in the frequency of the power supply.

12. The vacuum chamber of claim 11, wherein the current detector includes an electric blower current detector for detecting a current flowing in the electric blower and an electric motor current detector for detecting a current flowing in the electric motor.

13. The vacuum cleaner of claim 12, wherein the electric blower current detector includes a variable factor detector for detecting variable factors other than the current flowing in the electric blower, wherein the current flowing in the electric blower is indirectly estimated based on the variable factors detected by the variable factor detector.

14. The vacuum cleaner of claim 11, further comprising a voltage detector for detecting a voltage of a power supply applied to the vacuum cleaner, wherein a predetermined level of a current is made to flow in the vacuum cleaner regardless of a change in the voltage of the power supply.

15. A vacuum cleaner comprising:

an electric blower;

an electric blower controller for controlling the electric blower;

an electric motor for driving a rotational brush for brushing dust particles to be removed from a surface to be cleaned;

an electric motor controller for controlling the number of rotation of the electric motor;

a current detector for detecting at least a total current equal to a sum of a current flowing in the electric motor and a current flowing in the electric blower;

a dust chamber provided upstream of the electric blower for collecting dust particles sucked by the electric blower; and a rotation number setting unit for setting the number of rotation of the electric motor, wherein, if the number of rotation set by the rotation number setting unit is not a maximum number of rotation, the total current is controlled to be kept a predetermined level by increasing an electric power of the electric blower, regardless of the number of rotation set by the rotation number setting unit, a condition of the surface to be cleaned and the dust particle amount in the dust chamber.

16. The vacuum chamber of claim 15, wherein the current detector includes an electric blower current detector for detecting a current flowing in the electric blower and an electric motor current detector for detecting a current flowing in the electric motor.

17. The vacuum cleaner of claim 16, wherein the electric blower current detector includes a variable factor detector for detecting variable factors other than the current flowing in the electric blower, wherein the current flowing in the electric blower is indirectly estimated based on the variable factors detected by the variable factor detector.

* * * * *